US007516576B1

(12) United States Patent
Mullane

(10) Patent No.: US 7,516,576 B1
(45) Date of Patent: Apr. 14, 2009

(54) SNOW STOP

(75) Inventor: Michael J. Mullane, Hudson, MA (US)

(73) Assignee: Berger Building Products, Inc., Feasterville, PA (US)

( * ) Notice: Subject to any disclaimer, the term of this patent is extended or adjusted under 35 U.S.C. 154(b) by 298 days.

(21) Appl. No.: 11/076,644

(22) Filed: Mar. 10, 2005

Related U.S. Application Data

(63) Continuation of application No. 09/967,250, filed on Sep. 28, 2001.

(60) Provisional application No. 60/241,627, filed on Oct. 19, 2000.

(51) Int. Cl.
*E04D 13/00* (2006.01)

(52) U.S. Cl. ..... 52/24

(58) Field of Classification Search ..... 52/24–26; 40/720, 748; 248/519, 523; D8/373, 499
See application file for complete search history.

(56) References Cited

U.S. PATENT DOCUMENTS

| | | | | | |
|---|---|---|---|---|---|
| 225,060 | A | * | 3/1880 | Johnson | 403/174 |
| D30,788 | S | | 5/1899 | Clark | |
| 2,079,768 | A | * | 5/1937 | Levow | 52/25 |
| 2,868,568 | A | * | 1/1959 | Frye | 403/171 |
| 3,296,750 | A | * | 1/1967 | Zaleski | 52/24 |
| 3,399,914 | A | * | 9/1968 | Grant | 52/655.2 |
| D232,174 | S | * | 7/1974 | Borde | D23/209 |
| 4,065,220 | A | * | 12/1977 | Ruga | 403/169 |
| 4,141,182 | A | | 2/1979 | McMullen | |
| D254,051 | S | | 1/1980 | Zaleski | |
| 4,467,581 | A | | 8/1984 | Francovitch | |
| 5,282,340 | A | | 2/1994 | Cline et al. | |
| 5,343,659 | A | | 9/1994 | Zaleski | |
| 5,349,791 | A | | 9/1994 | Zaleski | |
| D351,989 | S | | 11/1994 | Cline et al. | |
| 5,371,979 | A | * | 12/1994 | Kwiatkowski et al. | 52/24 |
| 5,400,552 | A | | 3/1995 | Negre | |
| D360,476 | S | | 7/1995 | Smeja et al. | D25/199 |
| 5,453,623 | A | * | 9/1995 | Wong et al. | 250/363.03 |
| D364,338 | S | | 11/1995 | Cline | |
| D364,556 | S | | 11/1995 | Lee et al. | |
| 5,471,799 | A | | 12/1995 | Smeja et al. | |

(Continued)

OTHER PUBLICATIONS

Berger Building Products Corp., "Your *One* Stop Snow Guard Shop," Bergerbros.com, 1997, nominal, downloaded Sep. 26, 2000, including Real-Tool® and Snow-Brakes® snowguards, models RT-200, RT-300, AP-300, AP-400, AP-516, SM, RTCLSM, RTCLSR, SB-190, No. 100, No. 100 Shoe, No. 1, No. 20, No. 2, No. 95, and SGLLC1.

(Continued)

*Primary Examiner*—Richard E Chilcot, Jr.
*Assistant Examiner*—Jessica Laux
(74) *Attorney, Agent, or Firm*—Christopher John Rudy

(57) ABSTRACT

Snow stop includes a base member, and a snow-restraining member. The snow stop can have a series of holes for ventilation of adhesive as well as for forming "glue-rivets" with cured adhesive, and can have slots (grooves) to the holes or boundary of the snow stop to assist in ventilating adhesive solvent. The holes and grooves also can provide for increased physical bonding with the adhesive and hence, roof. The base may be round with the snow-restrainer included in intersecting upstanding members.

20 Claims, 5 Drawing Sheets

U.S. PATENT DOCUMENTS

| | | | | |
|---|---|---|---|---|
| 5,522,185 | A | 6/1996 | Cline | |
| D372,421 | S | 8/1996 | Cline | |
| 5,570,557 | A | 11/1996 | Kwiatkowski et al. | |
| 5,613,328 | A * | 3/1997 | Alley | 52/25 |
| 5,655,334 | A | 8/1997 | Kwiatkowski | |
| 5,664,374 | A | 9/1997 | Lee | |
| 5,879,499 | A | 3/1999 | Corvi | |
| 5,901,507 | A | 5/1999 | Smeja et al. | |
| D418,403 | S | 1/2000 | Cline | |
| D419,863 | S | 2/2000 | Mullane | |
| 6,250,023 | B1 | 6/2001 | Donoho | 52/101 |
| 6,266,929 | B1 | 7/2001 | Cline | |
| 6,546,676 | B2 | 4/2003 | Wiesener et al. | 52/101 |
| 6,852,227 | B1 * | 2/2005 | Petrone | 210/616 |

OTHER PUBLICATIONS

M.J. Mullane Co., "Cast Snow & Ice Guards," brochure.
M.J. Mullane Co., "Snow Guards," brochure.
Snoblox, *Metal Architecture*, Aug. 2001, ad, p. 62.
Snojax Inc., *Metal Construction News*, ca. Jan. 1993, "A Space Age Snowguard for Metal Roof Surfaces," ad.
Mullane, U.S. Appl. No. 60/241,627, filed Oct. 19, 2000 A. D.
Mullane, U.S. Appl. No. 09/967,250, filed Sep. 28, 2001 A.D.

* cited by examiner

MJM-50X-CON

MJM-50X-CON

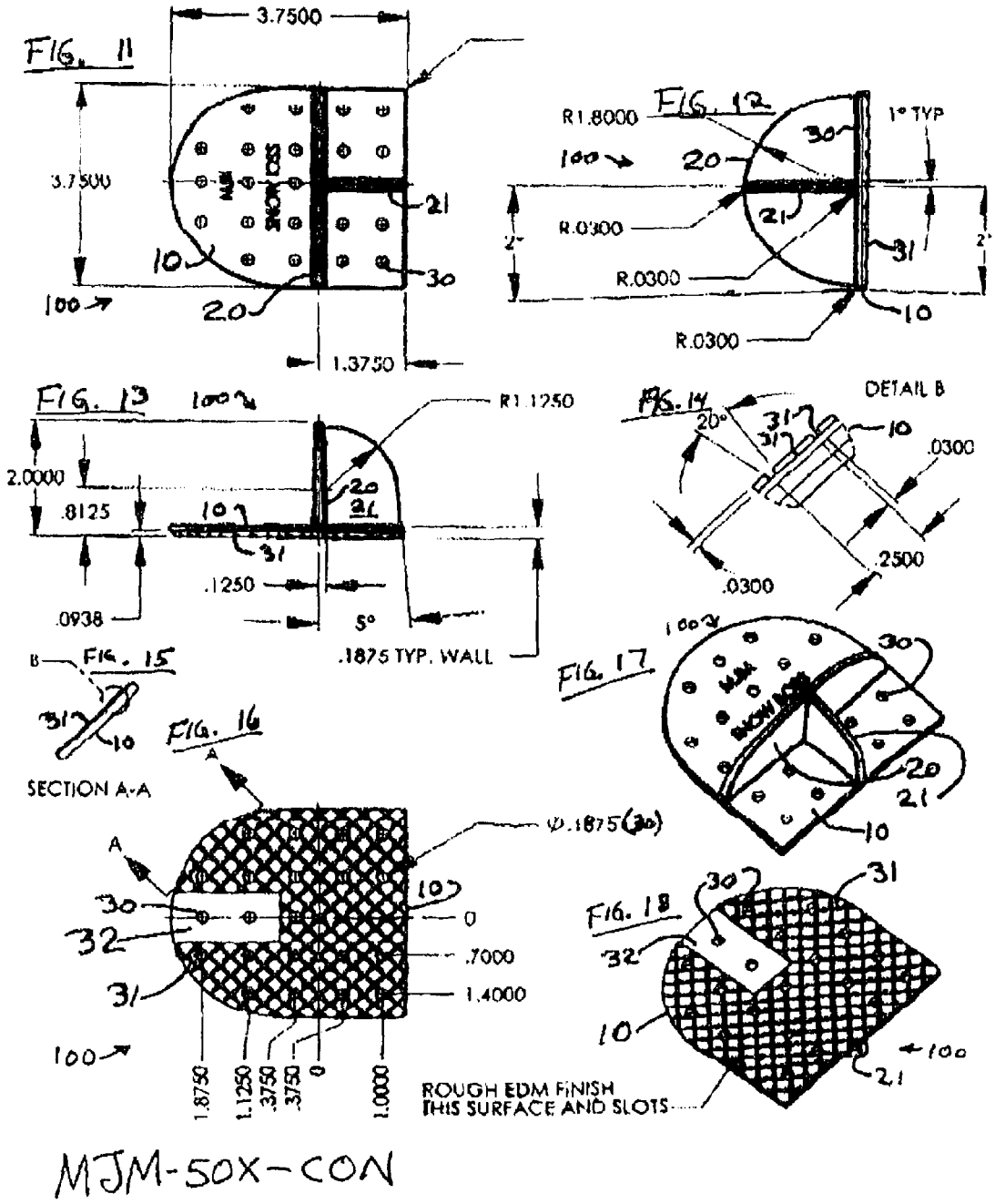
MJM-50X-CON 3.7500
R.0600
10
30
20
21
3.7500
1.0000
100
1.3750

1° TYP.
R1.8000
R.0300
R.0300
R.0300
.0300
2°

R1.1250
2.0000
1.3125
.1250
.0300 LAND
.1875 TYP. WALL

20°
.0300
DETAIL B
.2500

SECTION A-A

Ø.1875 (30)
0
.7000
1.4000
1.8750
1.1250
.3750
0
.3750
1.0000

ROUGH EDM FINISH
THIS SURFACE AND SLOTS
MJM-50X-CON

Ø5.0000
SNOW BOSS
MJM
Ø.1875 VENT HOLE/FASTENER HOLE (30)
Ø.1250 FASTENER HOLE
20/21
(UPSTANDING MEMBERS)
45°

R2.3497
.3000
45° S/O
R.0300
R.0300
4.8750
SECTION A-A

20/21
22
10
2.0000
.0938
2°
.0300 LAND
.1875 TYP. WALL

DETAIL B
.0300
20°
1° P/S
.2500

20/21
22
10
30

.8750
32
2.0000
1.0000
0
.3073
.9688
1.1470
1.6779
1.9375
30
31
10

22
32
10
31
30
ROUGH EDM FINISH THIS SURFACE AND SLOTS
20/21
MJM-50X-CON

SNOW STOP

CROSS REFERENCE

This claims benefit under 35 USC 119(e) of provisional patent application No. 60/241,627 filed on Oct. 19, 2000 A.D., and claims benefit under 35 USC 120 as a continuation of utility patent application No. 09/967,250 filed on Sep. 28, 2001 A.D. The complete specifications of those U.S. applications are incorporated herein by reference.

BACKGROUND OF THE INVENTION

I. Field and Purview:

In general, the present invention concerns a snow stop, useful for impeding a sudden avalanche of snow on a pitched roof. In particular, it especially concerns a snow stop that may be affixed to the roof with adhesive. It can have a series of grooves and/or vent holes for assisting in curing the adhesive.

II. Art with Problems:

Various snow guards are known. See, e.g., Clark, U.S. Pat. No. D307,88; Zaleski, U.S. Pat. No. D254,051; Cline et al., U.S. Pat. No. D351,989; Cline, U.S. Pat. No. D364,338; Lee et al., U.S. Pat. No. D364,556; Cline, U.S. Pat. No. D372,421; Cline, U.S. Pat. No. D418,403; Mullane, U.S. Pat. No. D419, 863; Zaleski, U.S. Pat. No. 3,296,750; Cline et al., U.S. Pat. No. 5,282,340; Zaleski, U.S. Pat. No. 5,343,659; Kwiatkowski et al., U.S. Pat. No. 5,371,979; Smeja et al., U.S. Pat. No. 5,471,799; Cline, U.S. Pat. No. 5,522,185; Kwiatkowski et al., U.S. Pat. No. 5,570,557; Kwiatkowski, U.S. Pat. No. 5,655,334; Lee, U.S. Pat. No. 5,664,374; and Smeja et al., 5,901,507. See also, Berger Building Products Corp., "Your One Stop Snow Guard Shop," electronic catalog, 1997; M. J. Mullane Co., "Cast Snow & Ice Guards," brochure, and "Snow Guards," brochure (comparing, www.bronzeguard-.com); and Snowjax, Inc., *Metal Construction News,* Jan. 1993 ad: "A Space Age Snowguard for Metal Roof Surfaces." Among snow guards, moreover, some are fastened to the roof by adhesives, and some of these are made of plastic. A problem with adhesive-attachment of snow guards to roofs is lack of strength, which can result in failure of the guard to adhere to the roof, especially under a load of snow or ice.

See also, Metal Architecture, August 2001, page 62, ad: "SNOWBLOX." Note, the '507 citation above, "Smeja et al.," is a U.S. Patent. Compare, Cline, U.S. Pat. No. 6,266,929; Zaleski, U.S. Pat. No. 5,349,791; McMullen, U.S. Pat. No. 4,141,182; Smeja et al., U.S, Pat. No. 5,471,799; Negre, U.S. Pat. No. 5,400,552; Corvi, U.S. Pat. No. 5,879,499; and Francovitch, U.S. Pat. No. 4,467,581. Note also, Wiesener et al., U.S. Pat. No. 6,546,676; Donoho, U.S. Pat. No. 6,250,023; Grant, U.S. Pat. No. 3,399,914; and Smeja et al., U.S. Pat. No. D360,476. Note further, Frye, U.S. Pat. No. 2,868,568; and Ruga, U.S. Pat. No. 4,065,220.

It would be desirable to ameliorate or overcome such vexing problems in the art.

SUMMARY OF THE INVENTION

In general, after conducting dedicated research into the problems in the art, especially as can relate to attachment of snow guards with adhesives, and discovering, among other things, that incomplete adhesive cure was a cause of many failures, the same at times engendered by an inability for adhesive solvents to appropriately escape the adhesive matrix, the present invention was conceived and developed. The invention provides a snow stop comprising a base member, and a snow-restraining member. In one particular embodiment, the snow stop has a series of holes for ventilation of adhesive as well as, as a further option, for insertion of fasteners such as nails, screws and/or staples, to fasten the device to a roof. Slots (grooves) to the holes or boundary of the snow stop may be provided. The holes and grooves also can provide for increased physical bonding with the adhesive and hence, roof. In another particular embodiment, the base is round and the snow restraining member is included in intersecting upstanding members, which, may, may be at a predetermined angle to each other, for example, at about ninety degrees. Other embodiments of the snow stop of the invention are extant.

Significantly, by the invention, vexing problems in the art are ameliorated if not overcome. The snow stop of the invention can engender better solvent evaporation from the adhesive under the base of the snow stop, with which the snow stop can be attached to the roof. Firmer attachment of the snow stop, and a more reliable performance and longer life, can thus be provided. In addition, the embodiment with the round base, particularly with generally symmetrical, upstanding members at right angles to one another, can be installed readily, and occasional misplacement on the roof is less noticeable.

Numerous further advantages attend the invention.

DRAWINGS OF INVENTION WITH ASSOCIATED DESCRIPTION

The appended drawings form part of the present specification, with respect to the drawings, which are not necessarily drawn to scale, the following is briefly noted:

FIG. 11 is an embodiment of a snow stop of the invention skin to the snow stop of FIGS. 1-7, but having a strap-attaching slot, showing preferred dimensions given in inches. Compare, FIG. 1.

FIG. 12 is a rear view of the snow stop of FIG. 11. Compare, FIG. 5.

FIG. 13 is a left side view of the snow stop of FIGS. 11 & 12, its right side being in essence a mirror image thereof. Compare, FIG. 4.

Figure 7:
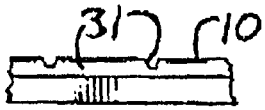
FIG. 7 is a detail of slots in the base of the snow stop of FIGS. 1-6. Note also, FIGS. 11-18.

FIG. 14 is a detailed view of slots in the base of the snow stop of FIGS. 11-13. Note, FIG. 15, circle B. Compare, FIG. 7.

FIG. 15 is a cross-sectional view of bottom slots in the base of the snow stop of FIGS. 11-14, taken along A-A (FIG. 16).

Figure 1:
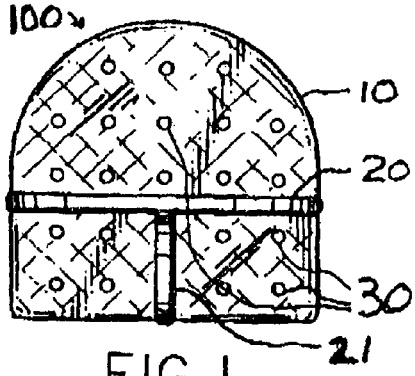
FIG. 1 is a top view of a snow stop of the present invention, which is made of a light-transmissive material, for example, of a polycarbonate plastic monolithically molded to form the device, its base having holes and a slotted, rough surfaced bottom.
Figure 2:
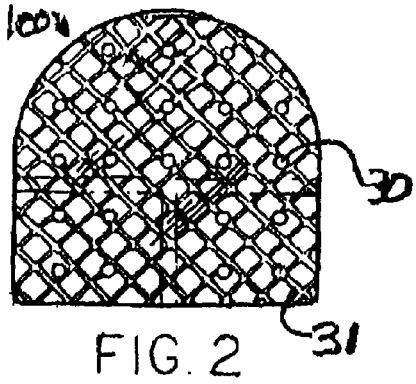
FIG. 2 is a bottom view of the snow stop of FIG. 1.
Figure 3:
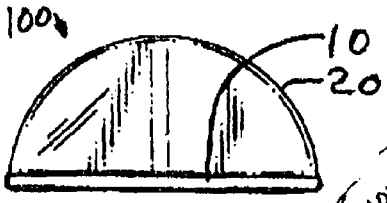
FIG. 3 is a front view of the snow stop of FIGS. 1 & 2.
Figure 4:
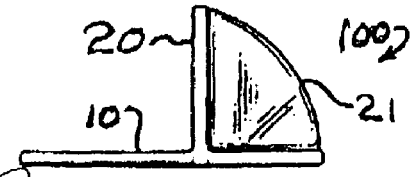
FIG. 4 is a left side view of the snow stop of FIGS. 1-3, its right side being in essence a mirror image thereof.
Figure 5:
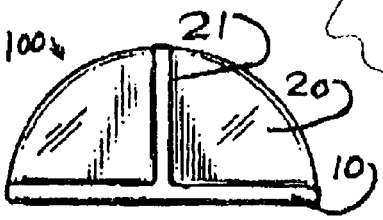
FIG. 5 is a rear view of the snow stop of FIGS. 1-4.

FIG. 16 is a bottom view of the snow stop of FIGS. 11-15. Compare, FIG. 2.

Figure 6:
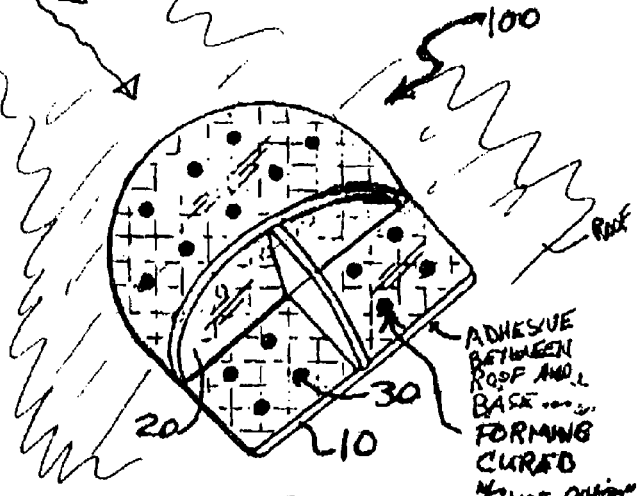
FIG. 6 is a top, left, rear perspective view of the snow stop of FIGS. 1-5, attached to a roof by a suitable adhesive.
Figure 8:
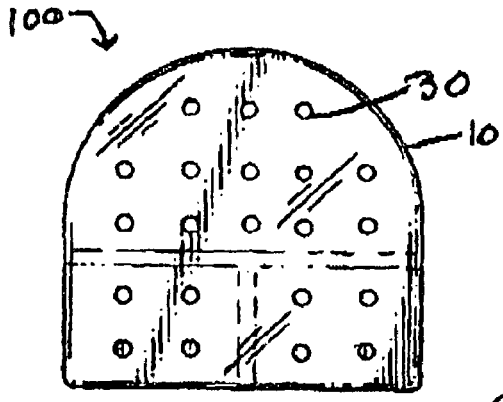
FIG. 8 is a bottom view of another embodiment of a snow stop of the invention, which is made of a light-transmissive material, for example, of a polycarbonate plastic monolithically molded to from the device, its base having holes but otherwise with a generally smooth bottom, and its shape otherwise akin to the snow stop of FIGS. 1-7.
Figure 10:
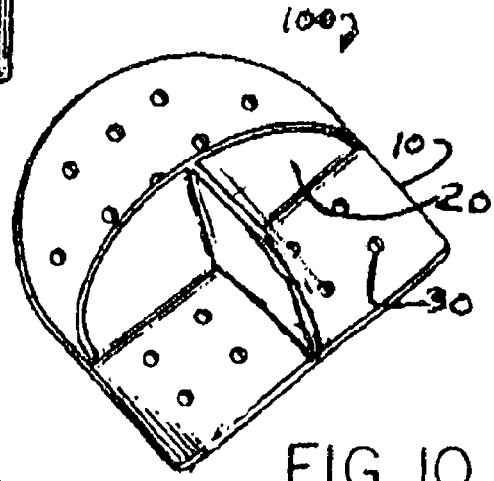
FIG. 10 is a perspective view of another embodiment of a snow stop of the invention, which is made of an opaque material, for example, a polyvinyl chloride plastic, opacified if necessary. monolithically molded to form the device, its base having holes, and its shapes otherwise akin to the snow stops of FIGS. 1-9.
Figure 9:
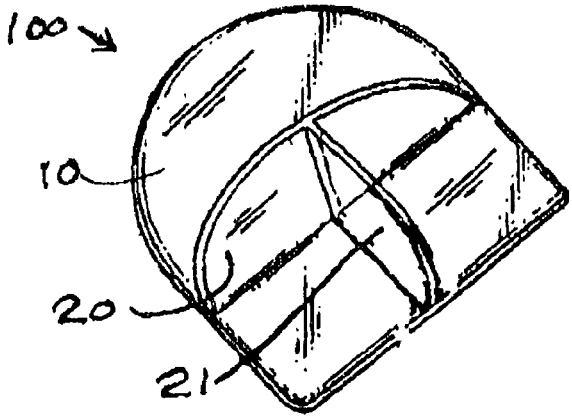
FIG. 9 is a perspective view of another embodiment of a snow stop of the invention, which is made of a light-transmissive material, for example, of a polycarbonate plastic monolithically molded to form the device, its base being without holes and with a generally smooth bottom, and its shapes otherwise akin to the snow stops of FIGS. 1-8.

FIG. 17 is a top, left, rear perspective view of the snow stop of FIGS. 11-16. Compare, FIG. 6.

FIG. 18 is a bottom, right, front perspective view of the snow stop of FIGS. 11-17.

Figures 19, 20, 21, 22, 23, 24, 25, 26:
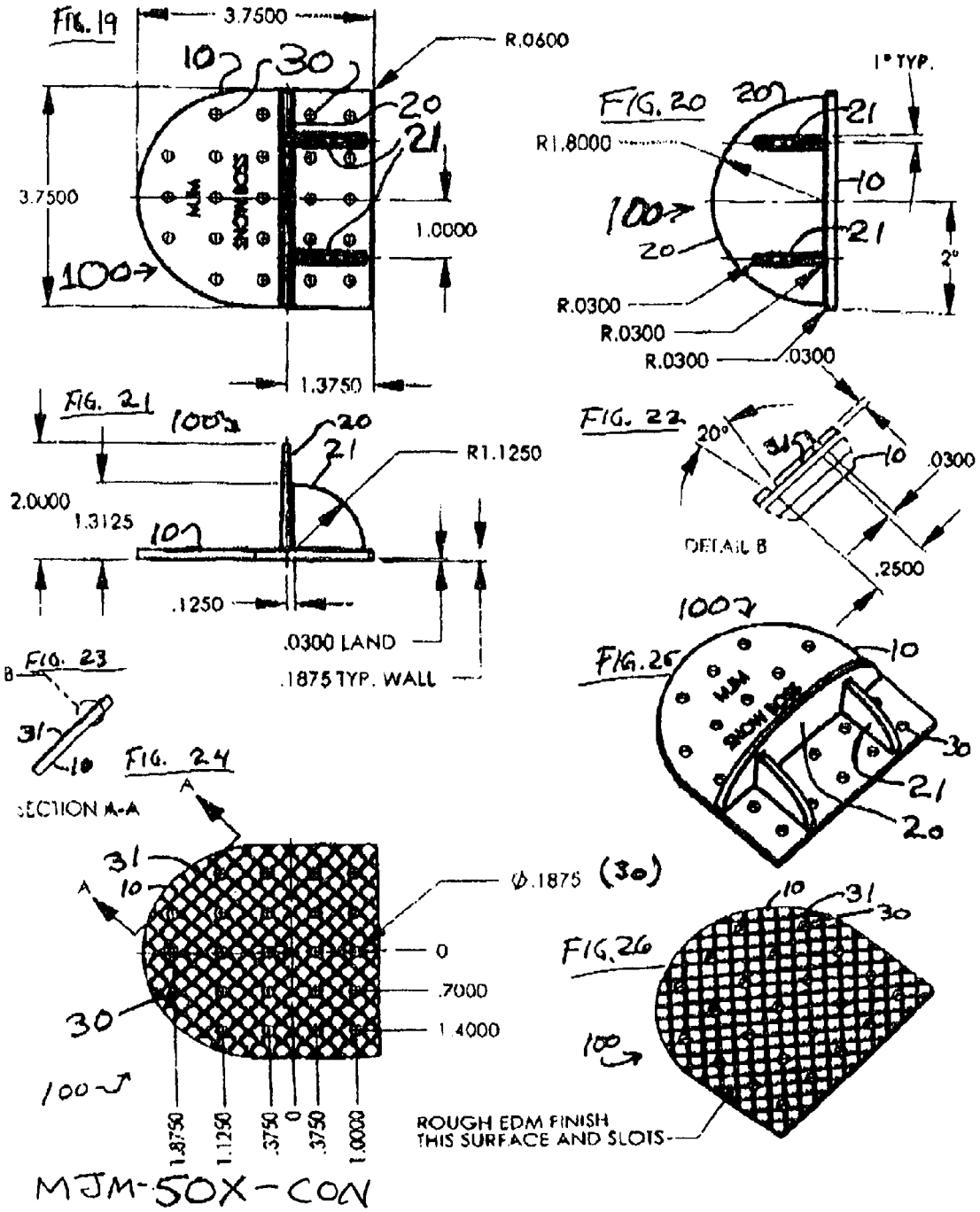

FIG. 19 is a top view of another embodiment of the invention, having two support members for its snow restraining member, but otherwise generally skin to the snow stop depicted in detail in FIGS. 11-18, with dimensions given in inches. Compare, FIG. 11.

FIG. 20 is a rear view of the snow stop of FIG. 19. Compare, FIG. 12.

FIG. 21 is a left side view of the snow stop of FIGS. 19 & 20, its right side being in essence a mirror image thereof. Compare, FIG. 13.

FIG. 22 is a detailed view of slots in the base of the snow stop of FIGS. 19-21. Note, FIG. 23, circle B. Compare, FIG. 14.

FIG. 23 is a cross-sectional view of bottom slots in the base of the snow stop of FIGS. 19-22 taken along A-A (FIG. 24). Compare, FIG. 15.

FIG. 24 is a bottom view of the snow stop of FIGS. 19-23. Compare, FIG. 16.

FIG. 25 is a top, left, rear perspective view of the snow stop of FIGS. 19-24. Compare, FIG. 17.

FIG. 26 is a bottom, right, front perspective view of the snow stop of FIGS. 19-25. Compare, FIG. 18.

Figures 27, 28, 29, 30, 31, 32, 33:
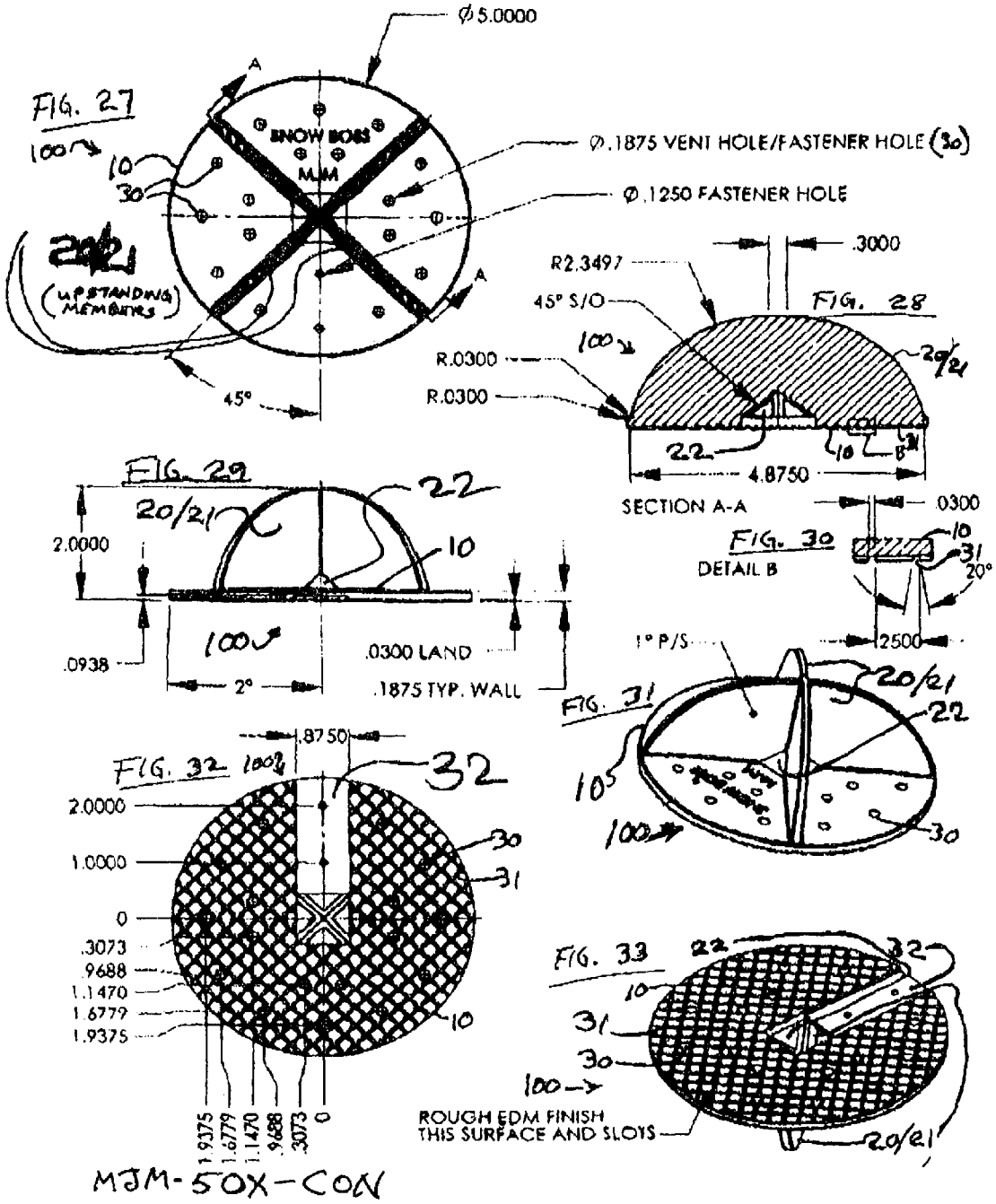

FIG. 27 is a top view of another embodiment of the present invention, having a round base and ventilation holes therein.

FIG. 28 is a side, cross-sectional view of an upstanding member snow stop of FIG. 27 taken along A-A (FIG. 27).

FIG. 29 is a side view of the snow stop of FIGS. 27 & 28, shown at a 45-degree angle in relation to its upstanding members.

FIG. 30 is a side, cross-sectional view of part of the base with slots of the snow stop of FIGS. 27-29, circle B in FIG. 28.

FIG. 31 is a top, perspective view of the snow stop of FIGS. 27-30.

FIG. 32 is a bottom view of the snow stop of FIGS. 27-31.

FIG. 33 is a bottom, perspective view of the snow stop of FIGS. 27-32.

FURTHER DETAIL ILLUSTRATIVE OF THE INVENTION

The invention can be further understood by the present detail, which may be read in view of the drawings. Such is to be taken in an illustrative, and not necessarily limiting, sense.

With respect to the drawings, snow stop 100 includes base member 10 and, upstanding from the base 10, snow-restraining member 20 (FIGS. 1-33). Support 21 may help brace the member 20 to resist advancing snow and ice (FIGS. 1-26 and 27-33) and/or itself restrain snow or ice, particularly when the stop 100 is configured for choice in orientation among several (FIGS. 27-33). Snow/ice/water relief opening 22 may be in the snow-restraining member 20 and/or brace 21. Holes 30 pass through the base 10 and can be connected with grooves or slots 31. The holes 30 may be evenly spaced to allow solvents in the adhesive to dissipate quickly, and become, as it were, "glue-rivets," when the adhesive keys into the holes, for a more secure application. A type of cross-hatch configuration with the grooves 31 also helps adhesive grip by increasing surface area and texture, and provides for a faster solvent escape, and hence, a faster and more complete adhesive curing. A rough or textured finish may be applied to the bottom surface of the base 10, holes 30 and/or grooves 31. This may decrease surface tension in order to increase adhesive holding power. Slot 32 may be provided for insertion of a securing hook or nailing strap such as made of metal (not illustrated) or may be absent, say, with grooves 31 in their place (FIGS. 1-6, 24 and 26), for a more extensive adhesive bond. In light of the adhesives commonly employed in the art, the snow stop 100 is particularly compatible with all non-copper metal roof systems. Its durable, rugged construction and configuration is structurally stable, with shapes and dimensions that can withstand severe loading. Thus, a preferred snow-restraining member 20 to base 10 ratio is 2:1, or thereabouts, for resisting peel and shear forces, and helping prevent breakage under load.

Any suitable material may be employed to make the snow stop of the invention; it may be made opaque or light-transmissive, in whole or in part; opaque; suitable metal, wood, ceramic, glass or plastic, for example, polyvinyl chloride (PVC), appropriately opacified if necessary; light-transmissive: suitable glass or plastic, for example, polycarbonate. The light-transmissive devices of the invention may be translucent or transparent, for example, substantially if not wholly transparent. The snow stop device of the present invention may be white, black, colorless (if light-transmissive) or of various color. The device may be made in component parts or monolithically, and it may be wholly or partly opaque or light-transmissive. Desirably, the device is wholly of one property as regards light and color, for example, wholly opaque white or wholly transparent blue. Exemplary plastic materials for use in making the snow stop of the invention include Lexan or Geon colored plastics. The plastic may be UV-stabilized. For example, Lexan plastic containing models can be transparent, and colorless or colored, with UV-light stabilizers added; Geon plastic containing models can be opaque, and white, black, or colored. Molding may be employed.

Shapes and dimensions of the snow step of the invention may vary. Thus, in addition to shapes seen in the drawings and such dimensions as in FIGS. 11-33, any other suitable shape or size of the device and its components may be employed. Grooves and/or holes may be the same or differing size(s) and/or shape(s). For example, round holes may be present, all of 0.375-inch diameters.

Testing of models such as that found in FIGS. 1-6 or 11-18 and as described hereinabove, with employment of the Geon plastic molding material, yielded the following: ASTM D792 specific gravity, 1.40; ASTM D2240 durometer D hardness, 80 pts; ASTM D638 tensile strength @2"/min., 7000 psi, tensile modulus @ 2"/min., 405000 psi, and ultimate elongation, 44%; ASTM D790 flexural strength, 11000 psi, and flexural modulus, 385000 psi; and ASTM D256 notched Izod impact, 73 F (23 C), ⅛ bars, 10 ft-lb/in.

CONCLUSION

The present invention is thus provided. Various features, parts, subcombinations and combinations can be employed with or without reference to other features, parts, subcombinations or combinations in the practice of the invention, and numerous and sundry adaptations and modifications can be effected within its spirit, the literal claim scope of which is particularly pointed out as follows:

I claim:

1. A snow stop comprising a base member and a snow-restraining member connected to a top side of the base member, wherein:

the base member is round, having a circular outer boundary;

the snow-restraining member is included in intersecting, upstanding members in at least one predetermined angle one to another, and said intersecting is at one and only one intersection of said upstanding members, and there is one and only one intersection of said upstanding member with respect to the base;

the base member has a substantially flat underside free from members corresponding to the upstanding members; and the snow stop is useful for attachment to a roof through the base member with the underside of the base member facing the roof; is durable, rugged and structurally stable; and, when attached to the roof through the base member with the underside of the base member facing the roof, can restrain and resist, and withstand severe loading from, advancing snow and ice on and moving down the roof; with the proviso that, when at least four of said upstanding members are present, a snow/ice/water relief opening is provided at what otherwise would be an intersection of the at least four of said upstanding members and the base member.

2. The snow stop of claim 1, wherein said intersecting is center of the base member, and said angle is normal with there being four and only four of said upstanding members present, which are disposed along two planes.

3. The snow stop of claim 2, wherein said upstanding members have convex, circularly bounded outer boundaries that span in uninterrupted arcs, each of which arcs defines a quarter circle, with no member present on the top side of the base spanning upstanding members along its outer boundary.

4. The snow stop of claim 1, in combination with a roof to which the snow stop is affixed.

5. The snow stop in combination with the roof of claim 4, wherein said intersecting is center of the beam member, and said angle is normal with there being four and only four of said upstanding members present, which are disposed along two planes.

6. The snow stop in combination with the roof of claim 5, wherein said upstanding members have convex, circularly bounded outer boundaries that span in uninterrupted arcs, each of which arcs defines a quarter circle.

7. The snow stop in combination with the roof of claim 4, wherein the snow stop is adhesively affixed.

8. The snow stop in combination with the roof of claim 5, wherein the snow stop is adhesively affixed.

9. The snow stop in combination with the roof of claim 6, wherein the snow stop is adhesively affixed.

10. The snow stop in combination with the roof of claim 7, wherein the snow stop has a series of holes through and grooves under the base member for ventilation of adhesive when adhesively applied to a roof and for "glue-rivets" in the holes with cured adhesive, wherein "glue-rivets" are formed with the adhesive.

11. The snow stop in combination with the roof of claim 8, wherein the snow stop has a series of holes through and grooves under the base member for ventilation of adhesive when adhesively applied to a roof and for "glue-rivets" in the holes with cured adhesive, wherein "glue-rivets" are formed with the adhesive.

12. The snow stop in combination with the roof of claim 9, wherein the snow stop has a series of holes through and grooves under the base member for ventilation of adhesive when adhesively applied to a roof and for "glue-rivets" in the holes with cured adhesive, wherein "glue-rivets" are formed with the adhesive.

13. A snow stop comprising a base member, and a snow-restraining member connected to a top side of the base member, wherein the base member has a substantially flat underside free from any member corresponding to the snow-restraining member on the top side; and a series of holes is present through the base member and connected with grooves under the base member to provide for ventilation of an adhesive when adhesively applied to a roof and for "glue-rivets" in the holes with cured adhesive.

14. The snow stop of claim 13, wherein a rough or textured surface is also present across a substantial portion of the underside.

15. The snow stop of claim 13, wherein the grooves have trapezoidal shapes when viewed along groove length axes.

16. The snow stop of claim 13, in combination with and adhesively affixed to a roof.

17. In combination, a snow stop and a roof to which the snow stop is affixed, the snow stop comprising a base member and a snow-restraining member connected to a top side of the base member, wherein:

the base member is round, having a circular outer boundary;

the snow restraining member is included in intersecting, upstanding members in at least one predetermined angle one to another, wherein said upstanding members are at least three in number with convex, circularly bounded outer boundaries that span in uninterrupted arcs, each of which arcs defines a quarter circle; and the base member has a substantially flat underside free from members corresponding to said upstanding members;

and wherein, in the combination, the snow stop is affixed to the roof by attachment with or through the base member of the snow stop; and at least one of the following features is present;

a slot is provided to the underside of the base member for insertion of a securing hook or nailing strap, which extends and opens to the circumference of the base member; and the snow stop is affixed to the roof with adhesive.

18. The combination of claim 17, wherein said intersecting is center of the base member, and said angle is normal with four of said upstanding members disposed along two planes.

19. The combination of claim 17, wherein said slot is provided.

20. The combination of claim 17, wherein no said slot is provided, but the snow stop is affixed to the roof with adhesive.

* * * * *